US010888501B2

(12) United States Patent
Fujii

(10) Patent No.: US 10,888,501 B2
(45) Date of Patent: Jan. 12, 2021

(54) MEDICINE SUPPLY APPARATUS

(71) Applicant: Takazono Technology Incorporated, Hirakata (JP)

(72) Inventor: Takayuki Fujii, Hirakata (JP)

(73) Assignee: TAKAZONO TECHNOLOGY INCORPORATED, Osaka (JP)

( * ) Notice: Subject to any disclaimer, the term of this patent is extended or adjusted under 35 U.S.C. 154(b) by 0 days.

(21) Appl. No.: 15/777,769

(22) PCT Filed: Oct. 21, 2016

(86) PCT No.: PCT/JP2016/081242
§ 371 (c)(1),
(2) Date: May 21, 2018

(87) PCT Pub. No.: WO2017/090353
PCT Pub. Date: Jun. 1, 2017

(65) Prior Publication Data

US 2018/0333334 A1 Nov. 22, 2018

(30) Foreign Application Priority Data

Nov. 25, 2015 (JP) ..... 2015-229365

(51) Int. Cl.
*A61J 7/00* (2006.01)
*G07F 11/62* (2006.01)
(Continued)

(52) U.S. Cl.
CPC ..... *A61J 7/0076* (2013.01); *G07F 11/54* (2013.01); *G07F 11/62* (2013.01); *G07F 17/0092* (2013.01)

(58) Field of Classification Search
CPC ..... A61J 3/00; A61J 7/0076; A61J 7/0084; G07F 11/62; G07F 17/0092
See application file for complete search history.

(56) References Cited

U.S. PATENT DOCUMENTS 4,664,289 A 5/1987 Shimizu et al.
5,277,534 A * 1/1994 Anderson ..... G11B 15/6835 312/107
(Continued)

FOREIGN PATENT DOCUMENTS

CN 101909576 A 12/2010
CN 103260580 A 8/2013
(Continued)

OTHER PUBLICATIONS

International Search Report dated Dec. 27, 2016, issued in counterpart application No. PCT/JP2016/081242. (2 pages).
(Continued)

*Primary Examiner* — Gene O Crawford
*Assistant Examiner* — Kelvin L Randall, Jr.
(74) *Attorney, Agent, or Firm* — Westerman, Hattori, Daniels & Adrian, LLP

(57) ABSTRACT

An arc-shaped divided body includes a plurality of medicine containing units each containing a medicine. The arc-shaped divided body has an inner circumferential surface. The inner circumferential surface has a partially cylindrical surface shape. An axial passage extending in an axial direction is formed inward in a radial direction of the partially cylindrical surface of the inner circumferential surface with respect to the arc-shaped divided body. The arc-shaped divided body is pivotable about a rotation axis. The rotation axis is located to be spaced apart from a center line of the partially cylindrical surfaces of the inner circumferential surfaces, and extends in parallel with the center line. In the state where the arc-shaped divided body is pivoted about the rotation axis in a direction away from the center line, the axial passage is exposed.

2 Claims, 10 Drawing Sheets

(51) Int. Cl.
*G07F 17/00* (2006.01)
*G07F 11/54* (2006.01)

(56) References Cited

U.S. PATENT DOCUMENTS

| | | | | |
|---|---|---|---|---|
| 5,667,096 | A * | 9/1997 | Wu | G07F 11/32 221/130 |
| 5,839,257 | A * | 11/1998 | Soderstrom | B65B 9/087 53/411 |
| 5,901,876 | A | 5/1999 | Yuyama et al. | |
| 5,946,883 | A * | 9/1999 | Yuyama | B65B 5/103 53/131.3 |
| 6,170,230 | B1 * | 1/2001 | Chudy | B65B 5/103 53/168 |
| 6,286,714 | B1 * | 9/2001 | Pearson | A61J 7/02 221/164 |
| 6,308,494 | B1 * | 10/2001 | Yuyama | B65B 5/103 53/131.3 |
| 6,625,952 | B1 * | 9/2003 | Chudy | B65B 5/103 221/129 |
| 6,874,684 | B1 * | 4/2005 | Denenberg | B65G 1/045 235/381 |
| 7,853,355 | B1 * | 12/2010 | Willemse | G07F 9/026 700/232 |
| 10,025,908 | B1 * | 7/2018 | Orellano | G16H 40/63 |
| 2003/0056467 | A1 | 3/2003 | Kim | |
| 2006/0124660 | A1 * | 6/2006 | Yuyama | B65B 5/103 221/265 |
| 2007/0157551 | A1 * | 7/2007 | Yuyama | G07F 11/165 53/281 |
| 2009/0266029 | A1 | 10/2009 | Kim | |
| 2013/0270291 | A1 | 10/2013 | Omura et al. | |
| 2015/0014343 | A1 | 1/2015 | Koike | |
| 2018/0319570 | A1 * | 11/2018 | Baarman | B65D 83/0409 |
| 2018/0353385 | A1 * | 12/2018 | Zetterstrom | A61J 7/0076 |

FOREIGN PATENT DOCUMENTS

| | | | |
|---|---|---|---|
| CN | 104144857 | A | 11/2014 |
| EP | 2213274 | A1 | 8/2010 |
| GB | 2191768 | A | 12/1987 |
| JP | 62-566 | U | 1/1987 |
| JP | H03-111339 | U | 11/1991 |
| JP | 9-201399 | A | 8/1997 |
| JP | H11-124101 | | 5/1999 |
| JP | 2002-068102 | | 3/2002 |
| JP | 2003-512088 | A | 4/2003 |
| JP | 2005-211540 | A | 8/2005 |
| JP | 2008-029584 | | 2/2008 |
| JP | 2009-165871 | A | 7/2009 |
| JP | 2009-261932 | A | 11/2009 |
| WO | 00/32477 | A1 | 6/2000 |

OTHER PUBLICATIONS

Office Action dated Jul. 30, 2019, issued in counterpart JP application No. 2015-229365, with English translation. (17 pages).

Pre-Appeal Re-Examination Report dated Feb. 18, 2020, issued in counterpart JP Application No. 2015-229365, with English translation (7 pages).

Pre-Appeal Re-Examination Report dated Feb. 18, 2020, issued in counterpart JP Application No. 2020-000293, with English translation (7 pages).

Office Action dated Mar. 31, 2020, issued in counterpart CN Application No. 201680069235.3, with English Translation. (13 pages).

Office Action dated Oct. 6, 2020, issued in counterpart to JP Application No. 2020-002133, with English Translation. (9 pages).

* cited by examiner

MEDICINE SUPPLY APPARATUS

TECHNICAL FIELD

The present invention relates to a medicine supply apparatus, and particularly to a medicine supply apparatus configured to supply a tablet.

BACKGROUND ART

Conventionally, there has been a proposed apparatus having a structure formed of annularly-arranged feeder columns constituted of vertically-stacked medicine feeders each containing a medicine, in which in the state where an upper fulcrum in each of the feeder columns is pivotally supported, these feeder columns are opened outward to expose a medicine guide passage through which a medicine passes (for example, see Japanese Patent Laying-Open No. 09-201399 (PTD 1)).

CITATION LIST

Patent Document

PTD 1: Japanese Patent Laying-Open No. 09-201399

SUMMARY OF INVENTION

Technical Problem

According to the apparatus disclosed in PTD 1, the medicine guide passage is exposed, so that the inner wall of the medicine wide passage can be cleaned. However, since the feeder columns rotate about the upper fulcrum to be opened outward, the opened feeder columns are to extend in the oblique direction. Accordingly, when the inner wall on the feeder column side is cleaned, the inner wall needs to be accessed from obliquely below for cleaning, which makes it difficult to perform a cleaning operation. Furthermore, the angle at which the feeder columns can be pivoted about the fulcrum is limited. Thus, the working space is relatively narrow in the vicinity of the fulcrum, so that it is particularly difficult to perform the cleaning operation in the vicinity of the fulcrum.

An object of the present invention is to provide a medicine supply apparatus that allows easy cleaning of a passage through which a medicine passes.

Solution to Problem

A medicine supply apparatus according to the present invention includes: a plurality of arc-shaped divided bodies each having a plurality of medicine containing units each containing a medicine. The plurality of arc-shaped divided bodies each have an inner circumferential surface having a partially cylindrical surface shape. In a state where the plurality of arc-shaped divided bodies are arranged side by side such that inner circumferential surfaces of the plurality of arc-shaped divided bodies extend in a cylindrical shape, the plurality of medicine containing units are arranged side by side in an axial direction and in a circumferential direction of a partially cylindrical surface of each of the inner circumferential surfaces. An axial passage is formed to extend in the axial direction inward in a radial direction of the partially cylindrical surface of the inner circumferential surface with respect to each of the plurality of arc-shaped divided bodies, such that the medicine discharged from each of the plurality of medicine containing units passes through the axial passage. Each of the plurality of arc-shaped divided bodies is pivotable about a rotation axis that is spaced apart from a center line of partially cylindrical surfaces of the inner circumferential surfaces and that extends in parallel with the center line. The axial passage is exposed in a state where one of the plurality of arc-shaped divided bodies is pivoted about the rotation axis in a direction away from the center line.

In the medicine supply apparatus, the plurality of medicine containing units arranged in a plurality of rows in the circumferential direction are integrally pivotable about the rotation axis.

In the medicine supply apparatus, the inner circumferential surface of each of the plurality of arc-shaped divided bodies forms a wall surface of the axial passage.

In the medicine supply apparatus, the plurality of arc-shaped divided bodies are integrally pivotable about the center line of the inner circumferential surfaces.

Advantageous Effects of Invention

According to the medicine supply apparatus of the present invention, the passage through which a medicine passes can be readily cleaned.

DESCRIPTION OF EMBODIMENTS

Figure 1:
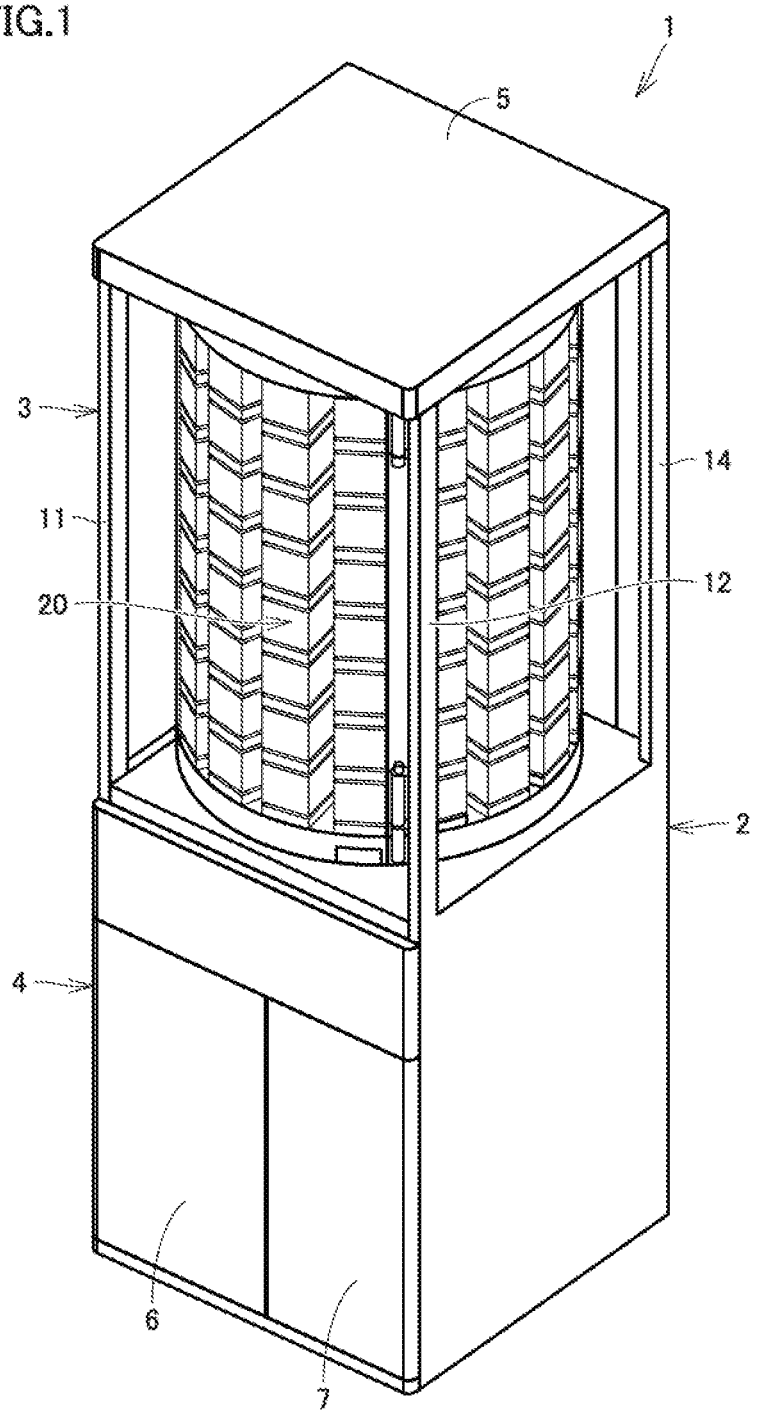
FIG. 1 is a perspective view showing the entire configuration of a medicine supply apparatus.

The embodiments of the present invention will be hereinafter described with reference to the accompanying drawings. In the accompanying drawings, the same or corresponding components are designated by the same reference characters, and description thereof will not be repeated.

FIG. 1 is a perspective view showing the entire configuration of a medicine supply apparatus 1. As shown in FIG. 1, medicine supply apparatus 1 of the present embodiment includes a housing 2 forming an outer shape of the apparatus. Housing 2 has an upper housing 3 and a lower housing 4. Upper housing 3 is disposed above lower housing 4. Lower housing 4 is disposed below upper housing 3.

A ceiling portion 5 is provided at the uppermost part of housing 2. Ceiling portion 5 has a rectangular shape in plan view. A left front pillar portion 11, a right front pillar portion 12, a left rear pillar portion 13 not shown in FIG. 1) and a right rear pillar portion 14 are provided at four corners of upper housing 3 seen in plan view. The upper ends of left front pillar portion 11, right front pillar portion 12, left rear pillar portion 13, and right rear pillar portion 14 each are coupled to ceiling portion 5. Ceiling portion 5 is supported by left front pillar portion 11, right front pillar portion 12, left rear pillar portion 13, and right rear pillar portion 14.

A drum 20 having an approximately cylindrical outer shape is disposed inside upper housing 3. The detailed configuration of drum 20 will be described later. Upper housing 3 is actually provided with a cover for covering the side surfaces on four sides. However, FIG. 1 and the figures described later fail to show the cover for the purpose of more clearly illustrating drum 20. The cover on the front side of upper housing 3 is configured to be openable and closable.

Lower housing 4 has a front surface provided with opening/closing doors 6 and 7. Opening/closing doors 6 and 7 are configured to be openable and closable. An operator who uses medicine supply apparatus 1 can open opening/closing doors 6 and 7 to take out the medicine dispensed in medicine wrapping paper or a vial from inside lower housing 4. Opening/closing doors 6 and 7 may be provided with an opening. Thus, the medicine dispensed in medicine wrapping paper or a vial may be able to be taken out through this opening.

Figure 2:
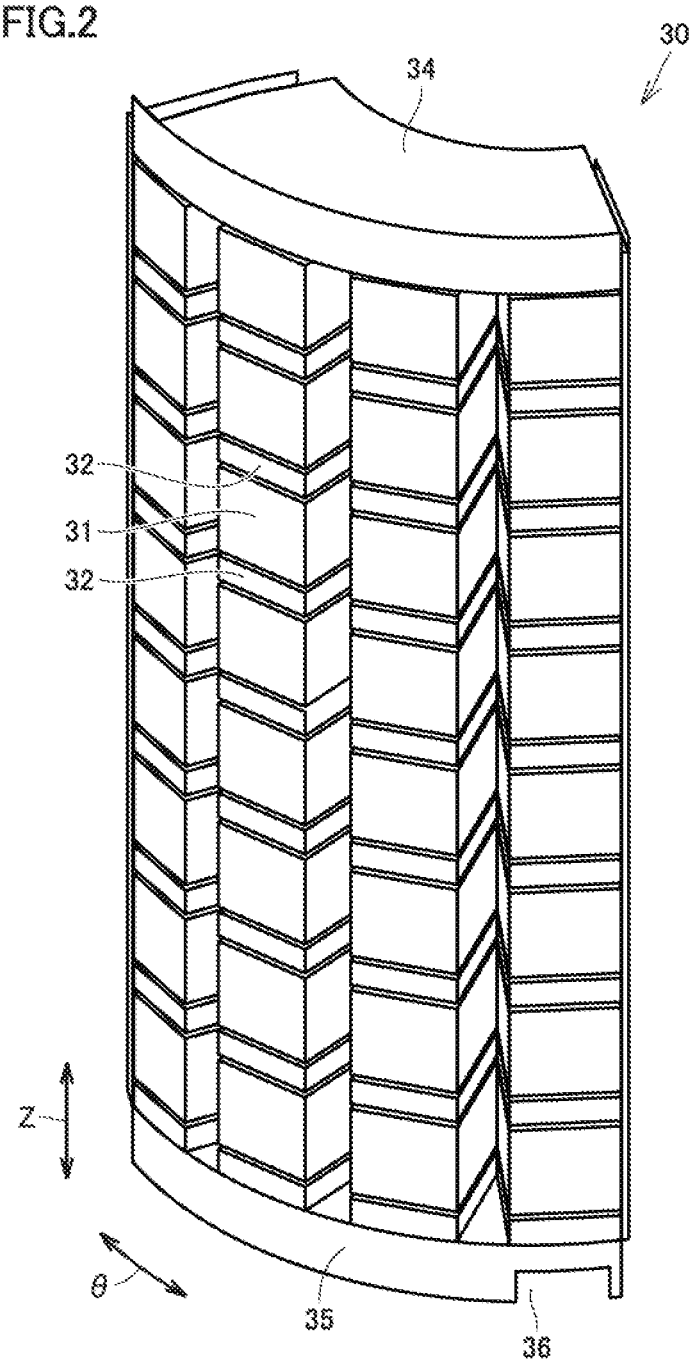
FIG. 2 is a perspective view showing the configuration of an arc-shaped divided body.

FIG. 2 is a perspective view showing the configuration of an arc-shaped divided body 30. Arc-shaped divided body 30 shown in FIG. 2 is obtained by dividing drum 20 having an approximately cylindrical shape shown in FIG. 1 in the circumferential direction. Arc-shaped divided body 30 has an approximate outer shape that is obtained by equally dividing a hollow cylinder in the circumferential direction. A plurality of arc-shaped divided bodies 30 are assembled to form drum 20 shown in FIG. 1. Drum 20 shown in FIG. 1 is a hollow cylindrical body that is formed by combining arc-shaped divided bodies 30.

Arc-shaped divided body 30 shown in FIG. 2 has a plurality of medicine containing units 31 and the same number of supports 32 as medicine containing units 31. Each medicine containing unit 31 is a hollow container. Medicine containing unit 31 has a cover portion that can be opened and closed. Medicine containing unit 31 has an internal space, in which a medicine is contained. The cover portion is opened, so that the medicine is received and housed in medicine containing unit 31. The dosage form of the medicine contained in medicine containing unit 31 in the present embodiment is a tablet. Medicine supply apparatus 1 in the present embodiment serves as an apparatus for supplying one type of packaged tablets or a plurality of types of packaged tablets.

Each of supports 32 is formed in a plate shape. Supports 32 are arranged to be spaced apart from each other. Medicine containing unit 31 is attached between upper and lower supports 32 so as to be attachable and detachable. Each medicine containing unit 31 is provided as a cassette so as to be attachable to and detachable from medicine supply apparatus 1.

Arc-shaped divided body 30 has an upper end portion provided with a ceiling portion 34 having a shape obtained by dividing an annular plate in the circumferential direction. Arc-shaped divided body 30 has a lower end portion provided with an outer sheath plate 35 having a shape obtained by dividing a thin-wailed cylinder in the circumferential direction. A part of outer sheath plate 35 is cut out to thereby form a hole portion 36. Hole portion 36 is formed such that the operator who uses medicine supply apparatus 1 can insert his/her fingers therethrough.

Figure 3:
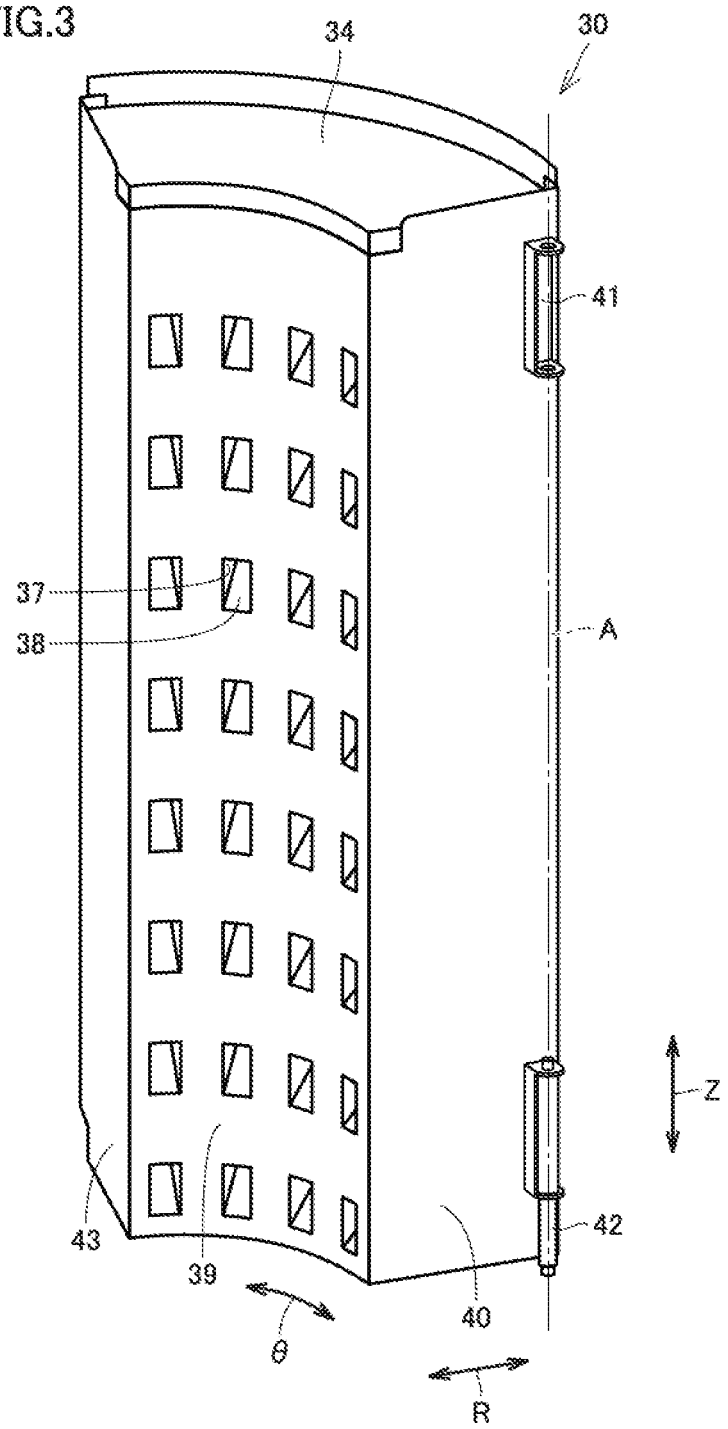
FIG. 3 is a perspective view of the arc-shaped divided body seen at an angle different from that in FIG. 2.

FIG. 3 is a perspective view of arc-shaped divided body 30 seen at an angle different from that in FIG. 2. As shown in FIG. 3, arc-shaped divided body 30 has an inner circumferential surface 39. Inner circumferential surface 39 is one surface of outer surfaces of arc-shaped divided body 30 obtained by dividing a hollow cylinder in the circumferential direction, this one surface being located to face the center line of the hollow cylinder. Inner circumferential surface 39 has a shape obtained by dividing a cylindrical surface in the circumferential direction. Inner circumferential surface 39 has a shape formed of a part of the cylindrical surface. Inner circumferential surface 39 has a partially cylindrical surface shape.

An axial direction Z shown in each of FIG. 3 and other figures indicates the axial direction of the partially cylindrical surface that forms inner circumferential surface 39. A radial direction R shown in each of FIG. 3 and other figures indicates the radial direction of the partially cylindrical surface that forms inner circumferential surface 39. A circumferential direction θ shown in each of FIG. 3 and other figures indicates the circumferential direction of the partially cylindrical surface that forms inner circumferential surface 39.

Arc-shaped divided body 30 is provided with a plurality of radial passages 37 extending in radial direction R. An inclined surface 38 inclined with respect to axial direction Z is provided inside each radial passage 37. Inclined surface 38 forms a bottom surface inside radial passage 37. Each radial passage 37 is opened at inner circumferential surface 39 of arc-shaped divided body 30. Furthermore, radial passage 37 is connected to the internal space of medicine containing unit 31 shown in FIG. 1. Radial passage 37 allows communication between each of medicine containing units 31 and inner circumferential surface 39.

As shown in FIG. 3, radial passages 37 are arranged in axial direction Z and also arranged in circumferential direction θ. As shown in FIG. 2, medicine containing units 31 are arranged in axial direction Z and also arranged in circumferential direction θ. Each medicine containing unit 31 and each radial passage 37 are arranged side by side in axial direction Z and in circumferential direction θ. Each medicine containing unit 31 is arranged to face the outer circumferential surface of arc-shaped divided body 30. Medicine containing unit 31 is provided to be movable in radial direction R. Each support 32 extends in radial direction R.

Arc-shaped divided body 30 has a first side surface 40 and a second side surface 43. First side surface 40 and second side surface 43 each have a flat plane shape. First side surface 40 and second side surface 43 extend in axial direction Z from the lower end to the upper end of arc-shaped divided body 30, and also extend in radial direction R from inner circumferential surface 39 to the outer circumferential surface of arc-shaped divided body 30.

An upper shaft support portion 41 is fixed to first side surface 40 of arc-shaped divided body 30. Upper shaft support portion 41 is provided with two through hole portions. These two through hole portions are provided to be spaced apart from each other in axial direction Z. Two through hole portions are formed circularly and have a common center in plan view. Upper shaft support portion 41 is provided so as to receive an upper pivot shaft portion (not shown) and to be rotatable with respect to the upper pivot shaft portion. This upper pivot shaft portion is attached to the framework of drum 20.

Furthermore, a lower pivot shaft portion 42 is attached to first side surface 40 of arc-shaped divided body 30. A lower shaft support portion is fixed to first side surface 40, and is provided with two through hole portions similar to those in upper shaft support portion 41. Lower pivot shaft portion 42 penetrates through a through hole portion provided in the lower shaft support portion. Lower pivot shaft portion 42 extends beyond and below the lower end of first side surface 40. Lower pivot shaft portion 42 engages with the framework of drum 20.

A rotation axis A shown by an alternate long and short dash line in FIG. 3 is an imaginary straight line extending in axial direction Z. Rotation axis A passes through the center of each of two through hole portions provided in upper shaft support portion 41 and extends through the axis line of lower pivot shaft portion 42. Rotation axis A acts as the center of rotation of arc-shaped divided body 30 described later. Arc-shaped divided body 30 is pivotable about rotation axis A.

Figure 4:
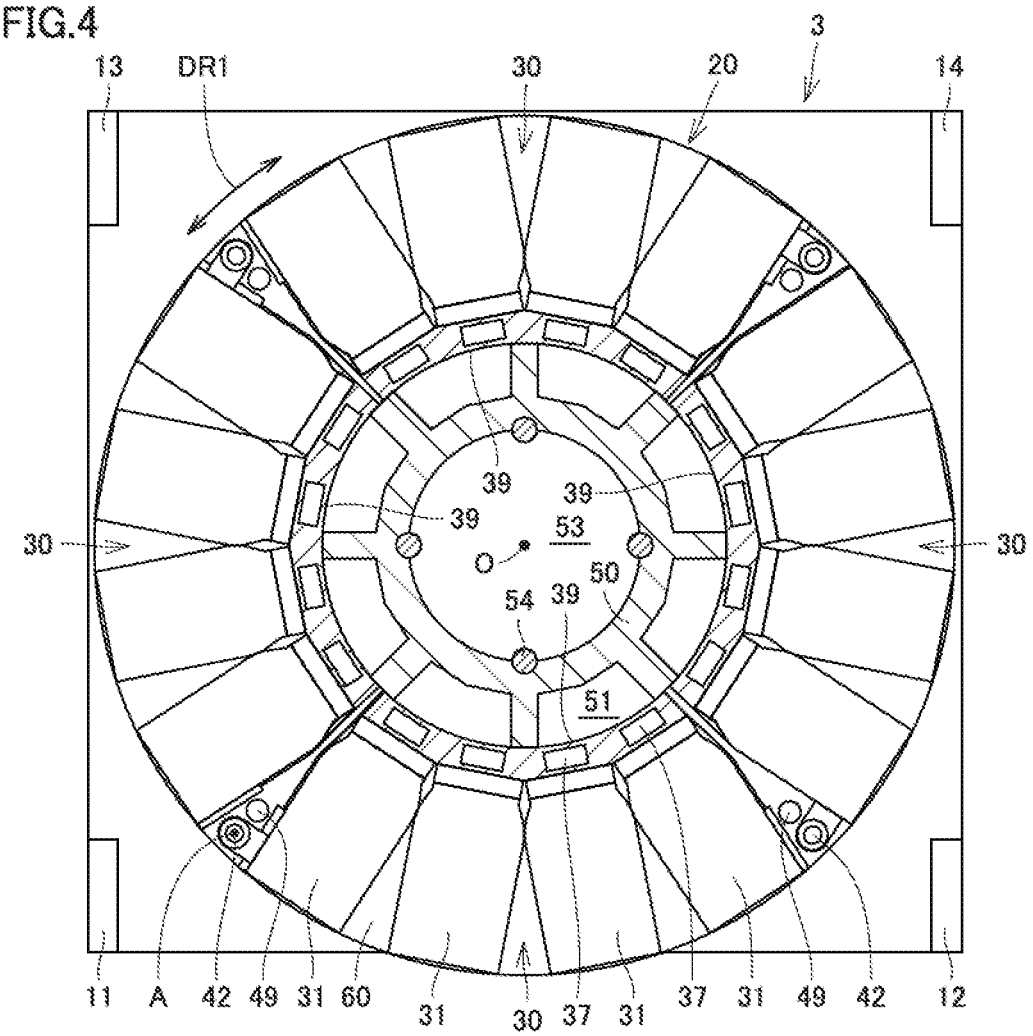
FIG. 4 is a partial cross-sectional view of the medicine supply apparatus.

FIG. 4 is a partial cross-sectional view of medicine supply apparatus 1. The partial cross-sectional view shown in FIG. 4 shows a lower cut surface obtained by cutting medicine supply apparatus 1 shown in FIG. 1 along the plane extending in the horizontal direction and passing through drum 20. As shown in FIG. 4, left front pillar portion 11, right front pillar portion 12, left rear pillar portion 13, and right rear pillar portion 14 are provided at four corners of upper housing 3 seen in plan view.

Drum 20 includes four arc-shaped divided bodies 30. Four arc-shaped divided bodies 30 as shown in FIGS. 2 and 3 are arranged side by side such that their inner circumferential surfaces 39 extend in a cylindrical shape, thereby forming an approximately cylindrical-shaped drum 20 shown in FIG. 4. Arc-shaped divided bodies 30 are obtained by dividing approximately cylindrical-shaped drum 20 into four parts in the circumferential direction. Each arc-shaped divided body 30 includes a plurality of medicine containing units 31 arranged in four rows in circumferential direction θ.

A center line O shown in FIG. 4 shows the center line of partially cylindrical surface-shaped inner circumferential surfaces 39 of arc-shaped divided bodies 30 arranged side by side as shown in FIG. 4. Center line O also shows the center line of approximately cylindrical-shaped drum 20. Center line O extends in the direction perpendicular to the surface of the sheet of paper showing FIG. 4. Rotation axis A shown in each of FIGS. 3 and 4 is located to be spaced apart from center line O and extends in parallel with center line O. Rotation axis A is provided in the vicinity of the outer circumferential edge of drum 20. Rotation axis A extends in the direction perpendicular to the surface of the sheet of paper showing FIG. 4. Axial direction Z shown in each of FIGS. 2 and 3 corresponds to the direction perpendicular to the surface of the sheet of paper showing FIG. 4.

Radial passage 37 described above is formed in the vicinity of center line O of drum 20 relative to medicine containing unit 31.

The plurality of arc-shaped divided bodies 30 are arranged in the circumferential direction about center line O to thereby form a hollow cylindrical shape. The plurality of arc-shaped divided bodies 30 are integrally pivotable about center line O as in a pivot direction DR1 indicated by a double-headed arrow in FIG. 4. The plurality of arc-shaped divided bodies 30 are provided so as to be rotatable with respect to upper housing 3, and configured to be movable sequentially one by one to the front surface side of medicine supply apparatus 1. The lower side in FIG. 4 corresponds to the front surface side of medicine supply apparatus 1.

A support pillar 50 forming a part of the framework of drum 20 is disposed in the vicinity of center line O relative to arc-shaped divided body 30. Support pillar 50 extends along center line O in the direction perpendicular to the surface of the sheet of paper showing FIG. 4. Support pillar 50 is formed to be hollow. A hollow space 53 is formed inside support pillar 50. Four structural pillars 54 are disposed on the inner circumferential surface of support pillar 50 that faces hollow space 53. Each structural pillar 54 has a solid cylindrical pillar shape extending in the direction perpendicular to the surface of the sheet of paper showing FIG. 4.

Support pillar 50 has an outer circumferential surface provided with a plurality of groove shapes extending in the direction perpendicular to the surface of the sheet of paper showing FIG. 4. Each of these groove shapes forms an axial passage 51 extending in axial direction Z. Axial passage 51 is formed inward in radial direction R with respect to arc-shaped divided body 30. Inner circumferential surface 39 of arc-shaped divided body 30 faces axial passage 51. Inner circumferential surface 39 of arc-shaped divided body 30 forms a part of the wall surface of axial passage 51. Inner circumferential surface 39 forms the wall surface on the outer circumferential side of axial passage 51.

As shown in FIG. 4, in the present embodiment, the outer circumferential surface of support pillar 50 is provided with axial passages 51 at eight positions in the circumferential direction. Two axial passages 51 are provided for one arc-shaped divided body 30. One axial passage 51 is provided for two medicine containing units 31. One axial passage 51 is provided for two radial passages 37. Radial passage 37 communicates with axial passage 51. Medicine containing unit 31 and axial passage 51 communicate with each other through radial passage 37.

A reinforcing stay 49 is disposed in the vicinity of center line O relative to each lower pivot shaft portion 42. In the present embodiment, drum 20 has four arc-shaped divided bodies 30 and four lower pivot shaft portions 42, so that reinforcing stays 49 are also provided at four positions. Each reinforcing stay 49 extends in the direction perpendicular to the surface of the sheet of paper showing FIG. 4. Reinforcing stay 49 extends in the up-down direction from the vicinity of the lower end of upper housing 3 to the vicinity of the upper end thereof. Drum 20 includes a bottom plate 60 having a an annular flat plate shape and a ceiling plate (not shown) having the same shape as bottom plate 60. Reinforcing stay 49 has a lower end fixed to bottom plate 60. Reinforcing stay 49 has an upper end fixed to the ceiling plate.

Figure 5:
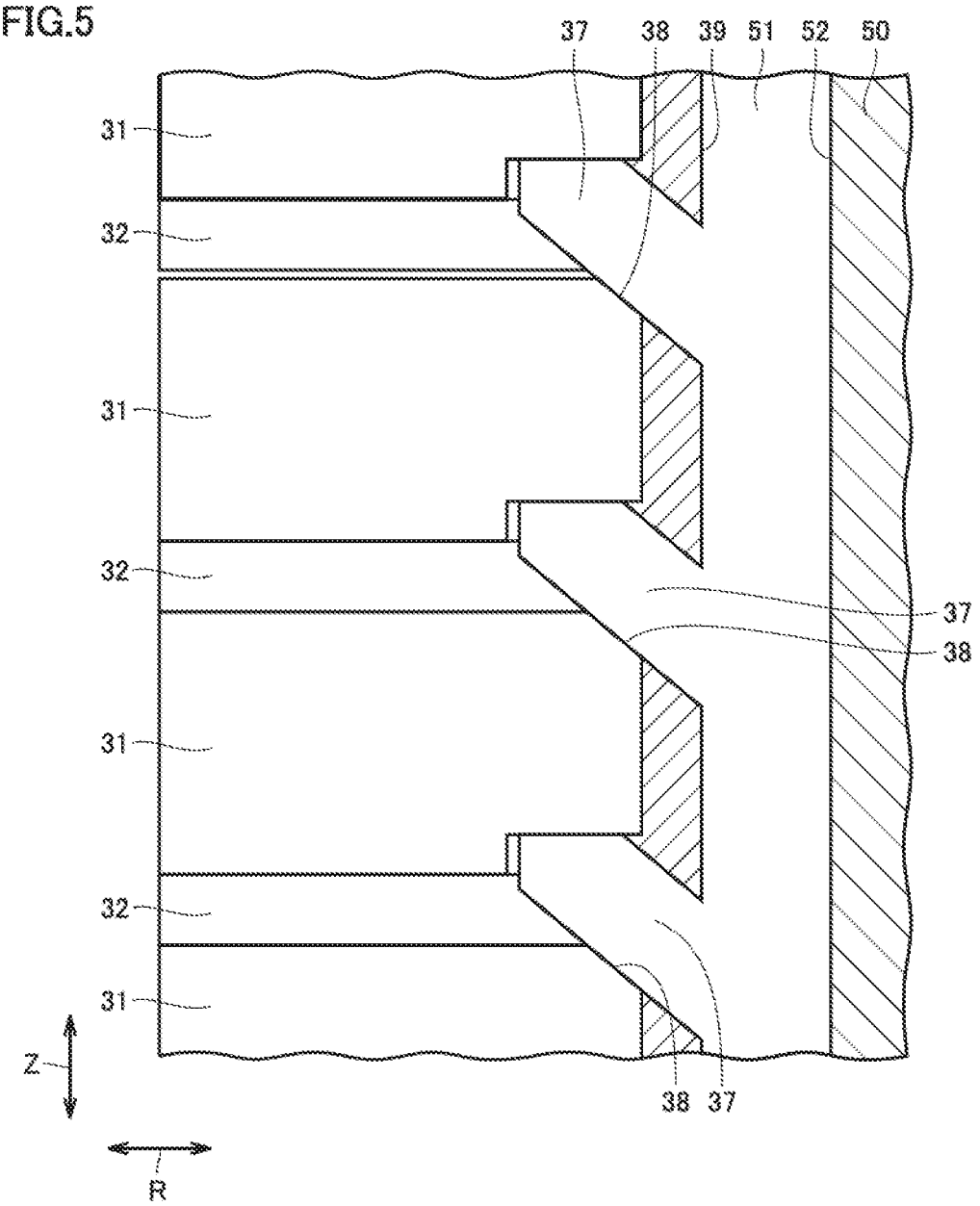
FIG. 5 is a partial cross-sectional view showing the configuration of a passage through which a medicine passes.

FIG. 5 is a partial cross-sectional view showing the configuration of a passage through which a medicine passes. As described above, medicine containing units 31 are arranged side by side in axial direction Z and sandwiched between upper and lower supports 32. Radial passage 37 communicates with each medicine containing unit 31. Radial passage 37 has an inclined surface 38. Radial passage 37 communicates with axial passage 51. Inner circumferential surface 39 of arc-shaped divided body 30 faces axial passage 51, and forms a part of the wall surface of axial passage 51. As shown in FIG. 5, an opposed surface 52 facing inner circumferential surface 39 forms a part of the wall surface of axial passage 51. Inner circumferential surface 39 and opposed surface 52 extend in axial direction Z so as to be formed approximately in parallel with each other.

Figure 6:
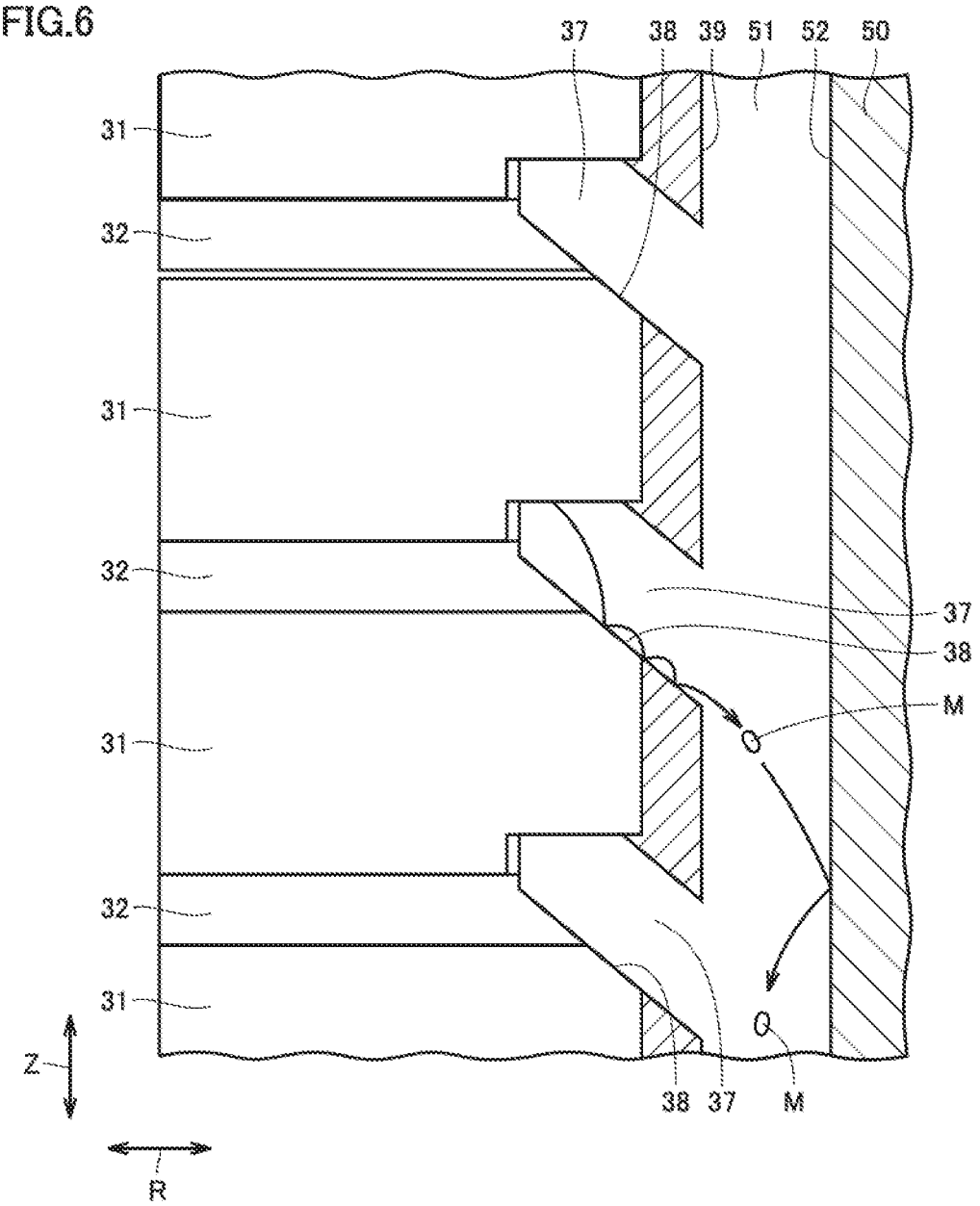
FIG. 6 is a partial cross-sectional view showing the medicine passing through the passage.

Radial passage 37 and axial passage 51 form a passage through which a medicine discharged from medicine containing unit 31 passes. FIG. 6 is a partial cross-sectional view showing a medicine M that passes through radial passage 37 and axial passage 51. As shown in FIG. 6, medicine M discharged from medicine containing unit 31 falls down sequentially through radial passage 37 and axial passage 51 so as to be supplied.

Medicine M passing through radial passage 37 moves along inclined surface 38 that forms the bottom surface of radial passage 37. Medicine M passing through radial passage 37 moves so as to slide down along inclined surface 38 or roll down along inclined surface 38.

Due to the momentum of medicine M falling down through radial passage 37, this medicine M having moved from radial passage 37 to axial passage 51 has a component of velocity from inner circumferential surface 39 toward opposed surface 52. As shown in FIG. 6, some medicines M reach opposed surface 52. Medicine M having reached opposed surface 52 collides with opposed surface 52, bounces off opposed surface 52, moves away from opposed surface 52, and then, falls down through axial passage 51 while moving closer to inner circumferential surface 39.

Figure 7:
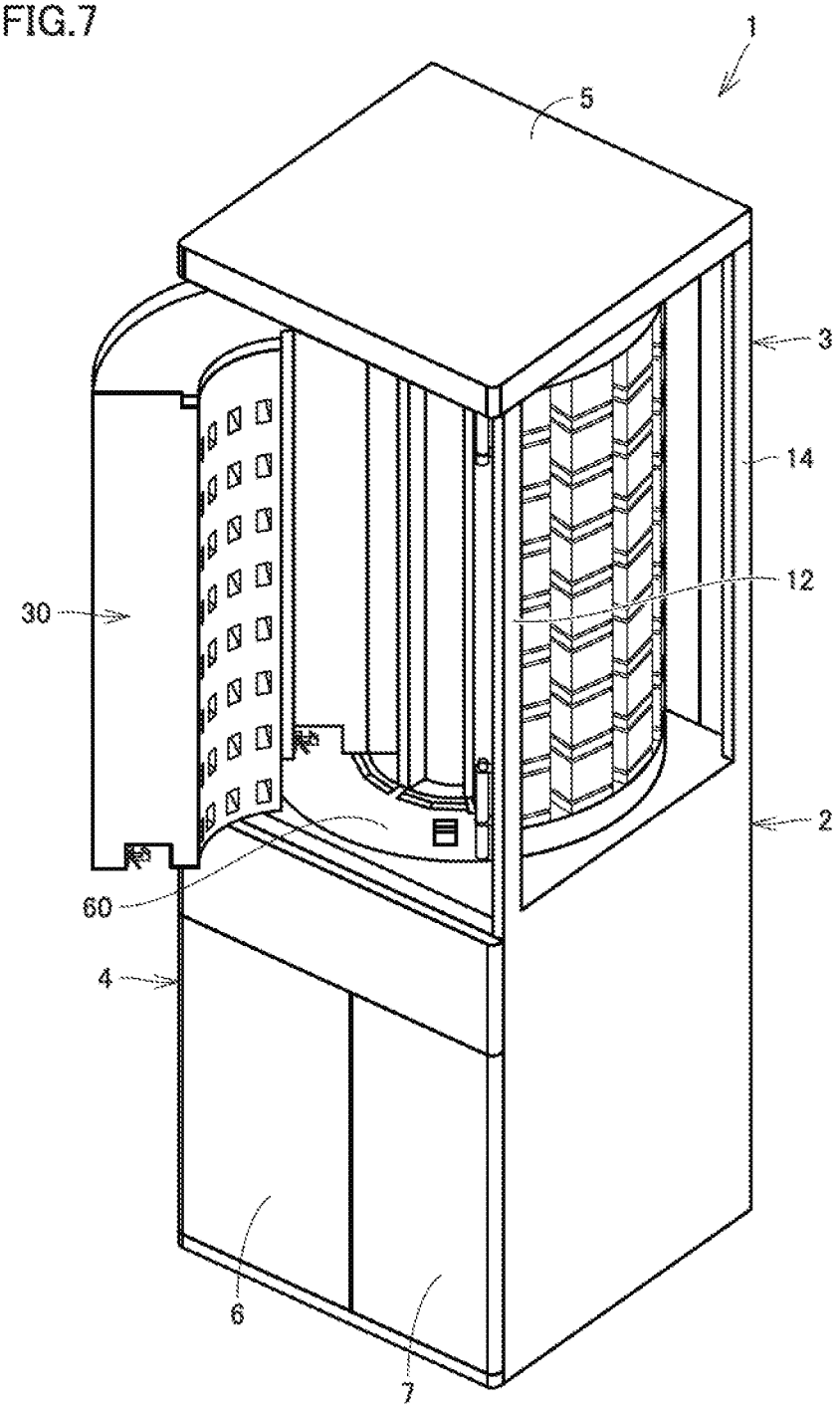
FIG. 7 is a perspective view showing the state where the arc-shaped divided body is rotated.
Figure 8:
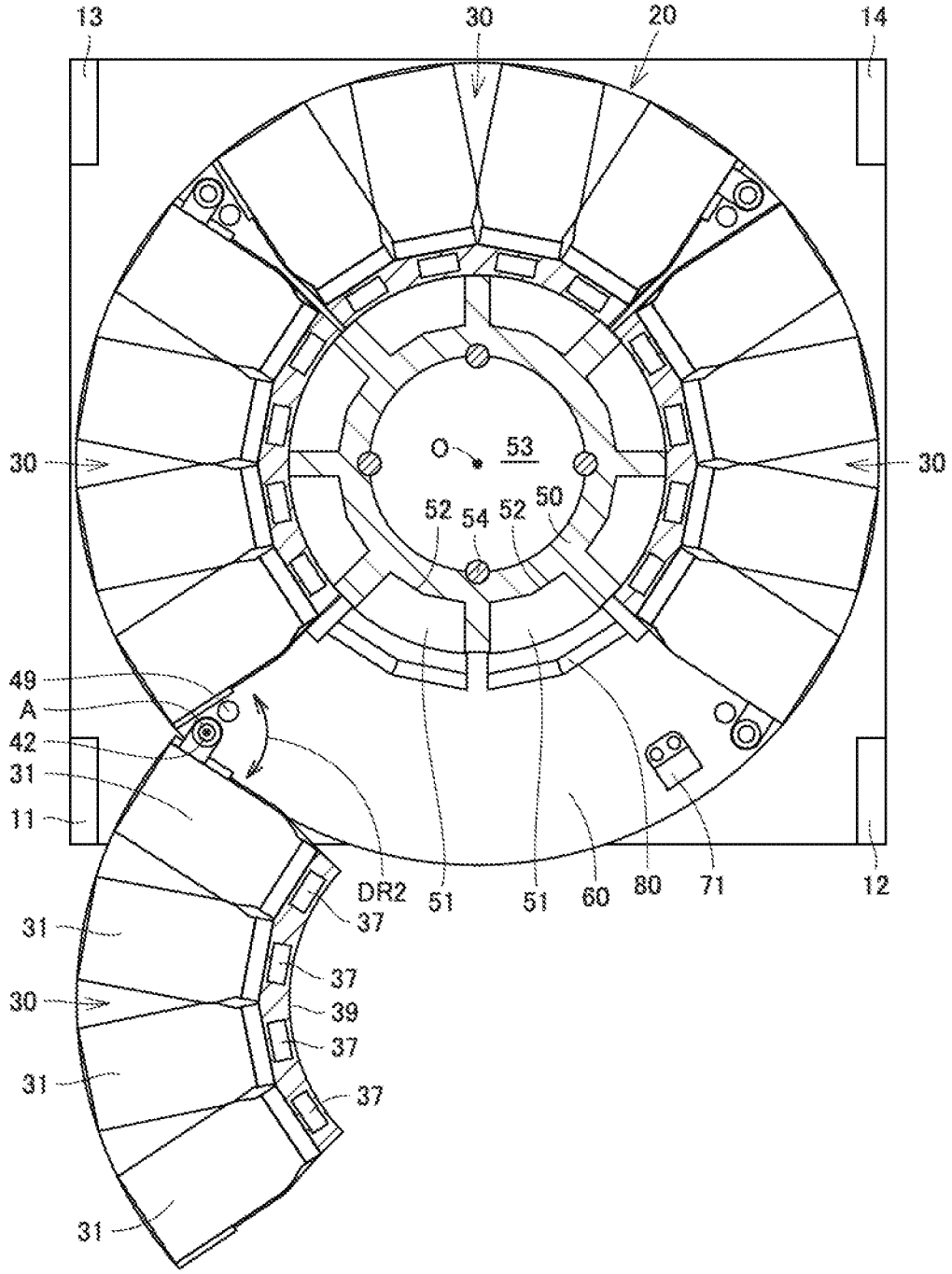
FIG. 8 is a partial cross-sectional view showing the state where the arc-shaped divided body is rotated.

FIG. 7 is a perspective view showing the state where arc-shaped divided body 30 is rotated. FIG. 8 is a partial cross-sectional view showing the state where arc-shaped divided body 30 is rotated. As shown in FIGS. 7 and 8, arc-shaped divided body 30 is pivotable about rotation axis A extending in axial direction Z. Arc-shaped divided body 30 is pivotable about rotation axis A as in a pivot direction DR2 indicated by a double-headed arrow in FIG. 8. As having been described with reference to FIG. 2, arc-shaped divided body 30 includes medicine containing units 31 arranged in a plurality of rows in circumferential direction θ. Medicine containing units 31 arranged in a plurality of rows in circumferential direction θ are integrally pivotable about rotation axis A.

In FIGS. 7 and 8, arc-shaped divided body 30 pivots outward in the radial direction of the approximately cylindrical shape of drum 20. Inner circumferential surface 39 of arc-shaped divided body 30 moves about rotation axis A as arc-shaped divided body 30 pivots. Inner circumferential surface 39 forms a wall surface of axial passage 51. As a result of movement of inner circumferential surface 39 by moving arc-shaped divided body 30 in a clockwise direction about rotation axis A as shown in FIG. 8, a part of the wall surface of axial passage 51 is moved. In the state where arc-shaped divided body 30 is pivoted about rotation axis A in the direction away from center line O as shown in FIGS. 7 and 8, axial passage 51 is exposed. In this state, the operator who uses medicine supply apparatus 1 can readily access the wall surfaces such as opposed surface 52 of axial passage 51, and inner circumferential surface 39 of arc-shaped divided body 30.

Figure 9:
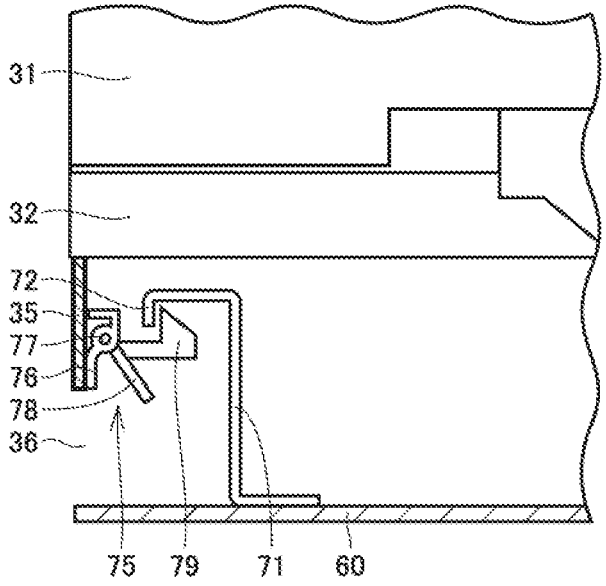
FIG. 9 is a partial cross-sectional view showing the configuration of a locking device of the arc-shaped divided body.

FIG. 9 is a partial cross-sectional view showing the configuration of a locking device of arc-shaped divided body 30. As shown in FIGS. 8 and 9, a receiving member 71 is fixed to bottom plate 60 of drum 20. Receiving member 71 has a tip end portion, at which an engagement portion 72 is formed.

A hook member 75 is attached to a portion of outer sheath plate 35 of drum 20, which is located above the position where hole portion 36 is formed. Hook member 75 includes a fixed portion 76, a rotation shaft portion 77, an operation portion 78, and a claw portion 79, as shown in FIG. 9. Fixed portion 76 is fixed to outer sheath plate 35. Rotation shaft portion 77 is attached to fixed portion 76. Operation portion 78 is configured such that, when the operator who uses medicine supply apparatus 1 inserts his/her fingers through hole portion 36, the fingers can get caught on this operation portion 78. Claw portion 79 is configured to be capable of engaging with engagement portion 72 of receiving member 71. Operation portion 78 and claw portion 79 are provided so as to be integrally rotatable about rotation shaft portion 77 as the center of rotation.

As seen in the right-left direction (radial direction R) in FIG. 9, claw portion 79 of hook member 75 and engagement portion 72 of receiving member 71 are located so as to overlap with each other. In the arrangement shown in FIG. 9, the tip end portion of claw portion 79 is arranged to be located farther away from outer sheath plate 35 than engagement portion 72 is. In the state shown in FIG. 9 where claw portion 79 of hook member 75 and engagement portion 72 of receiving member 71 engage with each other, arc-shaped divided body 30 is prevented from rotating about rotation axis A. Hook member 75 and receiving member 71 form a locking device for locking arc-shaped divided body 30 onto the framework of drum 20 so as not to be movable.

Figure 10:
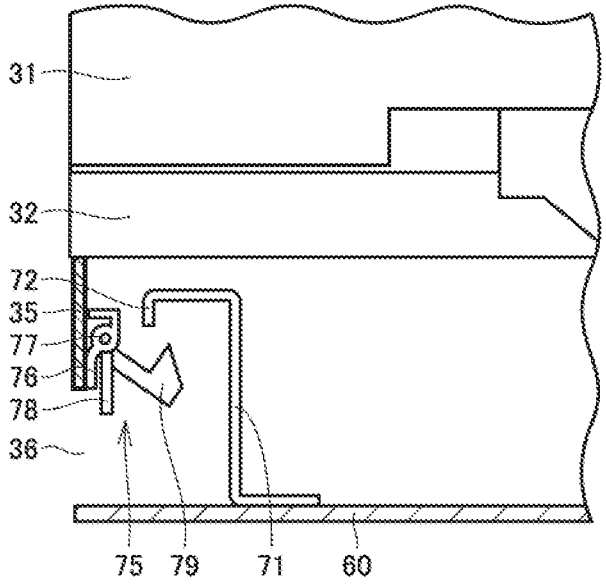
FIG. 10 is a partial cross-sectional view showing the state where locking of the arc-shaped divided body by the locking device is released.

FIG. 10 is a partial cross-sectional view showing the state where locking of arc-shaped divided body 30 by the locking device is released. When comparing FIG. 9 and FIG. 10, in FIG. 10, operation portion 78 and claw portion 79 rotate in the clockwise direction in the figure about rotation shaft portion 77 as the center of rotation. Such rotation of operation portion 78 and claw portion 79 is implemented by the operator inserting his/her fingers through hole portion 36 and pulling operation portion 78 toward this operator himself/herself.

As seen in the right-left direction (radial direction R) in FIG. 10, claw portion 79 of hook member 75 and engagement portion 72 of receiving member 71 are located so as not to overlap with each other. As compared with FIG. 9, when claw portion 79 is moved to rotate about rotation shaft portion 77, claw portion 79 of hook member 75 and engagement portion 72 of receiving member 71 are disengaged from each other, so that arc-shaped divided body 360 is unlocked. In this state, the operator pulls arc-shaped divided body 30 toward the operator himself/herself, thereby causing arc-shaped divided body 30 to rotate about rotation axis A.

Figure 11:
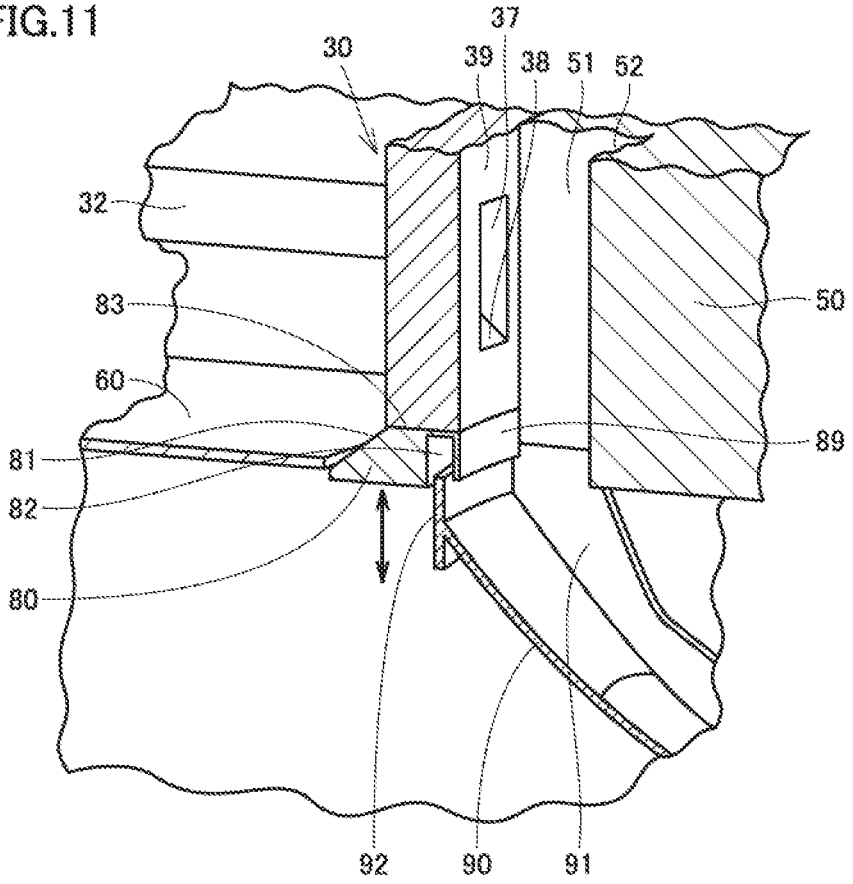
FIG. 11 is a partial cross-sectional view showing the configuration of a movable sealing member.

FIG. 11 is a partial cross-sectional view showing the configuration of a movable sealing member 80. FIG. 11 shows the lowermost part of drum 20, in which a part of the inner circumferential side portion of bottom plate 60 having an annular plate shape is shown on the left side in the figure.

A hopper 90 is disposed below axial passage 51. Hopper 90 receives medicine M having fallen down through axial passage 51, and supplies medicine M to a packaging apparatus (not shown) disposed below hopper 90. Hopper 90 is formed to have an approximately conical shape and to be hollow. On the inside of hopper 90, a guide passage 91 is formed, through which medicine M is guided to the packaging apparatus located therebelow. Guide passage 91 communicates with axial passage 51.

Hopper 90 has an outer circumferential edge, at which a rim portion 92 extending in the above-described axial direction Z is provided. Rim portion 92 extends in the same direction as the direction in which axial passage 51 extends. Rim portion 92 is disposed below the portion provided with radial passage 37 in arc-shaped divided body 30 and spaced apart from arc-shaped divided body 30.

Movable sealing member 80 is arranged between arc-shaped divided body 30 and hopper 90 in axial direction Z. Movable sealing member 80 has an inclined surface 81, a top flat surface 83, and an inner circumferential wall surface 89.

Inclined surface 81 faces the space provided between lowermost support 32 and bottom plate 60 that are shown in FIG. 11. In the arrangement of movable sealing member 80 shown in FIG. 11, inclined surface 81 faces the inner circumferential surface of bottom plate 60 having an annular plate shape. Top flat surface 83 contacts the lower surface of arc-shaped divided body 30. Inner circumferential wall surface 89 faces the passage through which medicine M passes. Inner circumferential wall surface 89 faces the boundary portion between axial passage 51 and guide passage 91 in the passages through which medicine M passes. Inner circumferential wall surface 89 continuously extends to inner circumferential surface 39 of arc-shaped divided body 30, and extends on approximately the same surface as inner circumferential surface 39.

Movable sealing member 80 is provided with a groove 82. Groove 82 is formed above rim portion 92 of hopper 90, and extends in the same direction as the direction in which rim portion 92 extends. A part of rim portion 92 can be received in groove 82. In the arrangement shown in FIG. 11, the upper end portion of rim portion 92 is arranged inside groove 82.

Movable sealing member 80 is provided to be capable of reciprocating in the direction indicated by a double-headed arrow shown in FIG. 11. A biasing member (not shown) serves to bias movable sealing member 80 in the upward direction. Movable sealing member 80 is biased by the biasing member in the extending direction of the double-headed arrow shown in FIG. 11 and also in the direction away from hopper 90.

In the state shown in FIGS. 7 and 8 where arc-shaped divided body 30 is pivoted to expose axial passage 51, arc-shaped divided body 30 is located so as not to contact movable sealing member 80. At this time, due to the biasing force from the biasing member as described above, movable sealing member 80 is located above the position shown in FIG. 11. When arc-shaped divided body 30 moves about rotation axis A in the counter clockwise direction from the position shown in FIGS. 7 and 8, and moves closer to support pillar 50, inner circumferential surface 39 of arc-shaped divided body 30 is brought into contact with inclined surface 81 of movable sealing member 80.

When arc-shaped divided body 30 further rotates in the state where it contacts inclined surface 81, arc-shaped divided body 30 slides along inclined surface 81. At this time, against the biasing force of the biasing member, the downward force is exerted from arc-shaped divided body 30 upon movable sealing member 80. Thereby, movable sealing member 80 moves downward. When arc-shaped divided body 30 further rotates, arc-shaped divided body 30 contacts top flat surface 83 of movable sealing member 80 and slides along top flat surface 83.

When arc-shaped divided body 30 is completely closed, arc-shaped divided body 30 is disposed at the position shown in FIG. 11. Top flat surface 83 is in contact with the lower surface of arc-shaped divided body 30. Then, movable sealing member 80 is located between arc-shaped divided body 30 and bottom plate 60, thereby forming a structure where no gap is formed between arc-shaped divided body 30 and bottom plate 60. Also, movable sealing member 80 is located between arc-shaped divided body 30 and hopper 90, thereby forming a structure where no gap is formed between arc-shaped divided body 30 and hopper 90. Thus, axial passage 51 and guide passage 91 inside hopper 90 are continuously connected to each other, thereby implementing a structure where a gap or an opening is not formed in the wall surface of the passage through which medicine M passes.

The following is a summarized explanation about the configuration and the functions and effects of medicine supply apparatus 1 in the present embodiment. It is to be noted that the components in the embodiments are designated by reference numerals, which are however merely by way of example.

A medicine supply apparatus 1 in the present embodiment includes a drum 20 as shown in FIG. 1. Drum 20 includes a plurality of arc-shaped divided bodies 30 as shown in FIG. 4. Each of arc-shaped divided bodies 30 includes a plurality of medicine containing units 31 each containing a medicine M, as shown in FIG. 2. As shown in FIG. 3, each arc-shaped divided body 30 has an inner circumferential surface 39. Inner circumferential surface 39 has a partially cylindrical surface shape. As shown in FIG. 4, in the state where the plurality of arc-shaped divided bodies 30 are arranged side by side such that inner circumferential surfaces 39 extend in a cylindrical shape, medicine containing units 31 are arranged side by side in an axial direction Z and in a circumferential direction θ of a partially cylindrical surface of each inner circumferential surface 39.

As shown in FIGS. 4 and 6, medicine supply apparatus 1 is provided with an axial passage 51 through which medicine M discharged from medicine containing unit 31 passes. Axial passage 51 extends in axial direction Z. Axial passage 51 is formed inward in a radial direction R of the partially cylindrical surface of inner circumferential surface 39 with respect to arc-shaped divided body 30. As shown in FIGS. 7 and 8, arc-shaped divided body 30 is pivotable about rotation axis A. Rotation axis A is located to be spaced apart from a center line O of the partially cylindrical surfaces of inner circumferential surfaces 39, and extends in parallel with center line O. In the state where arc-shaped divided body 30 is pivoted about rotation axis A in the direction away from center line O, axial passage 51 is exposed.

When medicine M moving through axial passage 51 is brought into contact with the wall surfaces of axial passage 51 such as an opposed surface 52 shown in FIGS. 5 and 6, shaving or chipping occurs on the surface of medicine M, and powder dust of medicine M adheres to the wall surface of axial passage 51. Accordingly, the wall surface of axial passage 51 needs to be periodically cleaned. According to the present embodiment, since axial passage 51 can be exposed by causing arc-shaped divided body 30 to pivot about rotation axis A, axial passage 51 through which medicine M passes can be readily cleaned.

Arc-shaped divided body 30 obtained by dividing an approximately cylindrical-shaped drum 20 in the circumferential direction is provided to be pivotable about rotation axis A that is in parallel with center line O of drum 20. Accordingly, the angle at which arc-shaped divided body 30 pivots about rotation axis A can be increased. Thereby, inner circumferential surface 39 of arc-shaped divided body 30 and opposed surface 52 of axial passage 51 can be largely exposed. Since a sufficient working space is ensured also in the vicinity of rotation axis A, the operator who uses medicine supply apparatus 1 can readily access inner circumferential surface 39 and opposed surface 52 in their entirety. Therefore, both inner circumferential surface 39 and opposed surface 52 can be readily cleaned.

The apparatus disclosed in Japanese Patent Laying-Open No, 09-201399 (PTD 1) requires the feeder column to be raised about the upper fulcrum in order to open a medicine guide passage, thereby increasing the operator's workload. On the other hand, according to medicine supply apparatus 1 in the present embodiment, arc-shaped divided body 30 is rotated about rotation axis A extending in the up-down direction, so that the operator can readily expose axial passage 51 with less workload.

Also shown in FIG. 8, medicine containing units 31 arranged in a plurality of rows in circumferential direction θ are integrally pivotable about rotation axis A. In this way, inner circumferential surface 39 of arc-shaped divided body 30 corresponding to medicine containing units 31 arranged in a plurality of rows in circumferential direction θ and axial passage 51 corresponding to medicine containing units 31 arranged in a plurality of rows in circumferential direction 9 can be exposed simultaneously by pivoting arc-shaped divided body 30 once. Also, the wall surfaces of axial passages 51 that need to be cleaned can be collectively exposed. Accordingly, the time and effort of the operator involved in cleaning can be reduced, and the time required for cleaning can be shortened.

Also as shown in FIGS. 5 and 6, inner circumferential surface 39 of arc-shaped divided body 30 forms a wall surface of axial passage 51. In this way, inner circumferential surface 39 of arc-shaped divided body 30 and the wall surface of axial passage 51 can be reliably exposed by pivoting arc-shaped divided body 30.

Also as shown in FIG. 4, the plurality of arc-shaped divided bodies 30 are integrally pivotable about center line O. In this way, drum 20 is rotated about center line O, so that the plurality of arc-shaped divided bodies 30 can be sequentially moved to the front surface side of medicine supply apparatus 1. Arc-shaped divided body 30 arranged on the front surface side is pivoted about rotation axis A to thereby expose axial passage 51, so that the wall surface of axial passage 51 can be readily cleaned.

The above-described explanation provides an example in which approximately cylindrical-shaped drum 20 includes four divided arc-shaped divided bodies 30, and each arc-shaped divided body 30 has medicine containing units 31 arranged in four rows in circumferential direction θ. Medicine containing units 31 may be pivotable for each row arranged in circumferential direction θ. However, when the number of dividing drum 20 in the circumferential direction is increased too much, the time and effort for cleaning are increased to thereby increase the cleaning time. Also, arc-shaped divided body 30 may not be pivotable due to occurrence of interference with arc-shaped divided body 30 located adjacent thereto. On the other hand, when the number of dividing drum 20 in the circumferential direction is too small, the pivoting angle of arc-shaped divided body 30 is to be limited due to occurrence of interference with the columns at four corners of upper housing 3. Accordingly, it is more preferable to provide an example in which drum 20 is divided by 90° into four parts as described in the above embodiment or an example in which drum 20 is divided by 7° into five parts.

Also as shown in FIG. 4, an explanation has been given with regard to an example in which arc-shaped divided bodies 30 are arranged in a row in the radial direction of cylindrical-shaped drum 20 about center line O, but not limited thereto, and a plurality of arc-shaped divided bodies 30 may be provided in a plurality of row in the radial direction of drum 20.

Also in plan views shown in FIGS. 4 and 8, an explanation has been given with regard to an example in which rotation axis A is provided in the clockwise direction in the circumferential direction of drum 20 with respect to arc-shaped divided bodies 30. Rotation axis A may be provided in the counter clockwise direction in the circumferential direction of drum 20 with respect to arc-shaped divided bodies 30 in this case, when arc shaped divided body 30 is pivoted about rotation axis A in the counter clockwise direction, axial passage 51 can be exposed.

Although the embodiments of the present invention have been described as above, it should be understood that the embodiments disclosed herein are illustrative and nonrestrictive in every respect. The scope of the present invention is defined by the terms of the claims, rather than the description above, and is intended to include any modifications within the meaning and scope equivalent to the terms of the claims.

REFERENCE SIGNS LIST

1 medicine supply apparatus, 2 housing, 3 upper housing, 20 drum, 30 arc-shaped divided body, 31 medicine containing unit, 32 support, 35 outer sheath plate, 36 hole portion, 37 radial passage, 38 inclined surface, 39 inner circumferential surface, 40 first side surface, 41 upper shaft support portion, 42 lower pivot shaft portion, 49 reinforcing stay, 50 support pillar, 51 axial passage, 52 opposed surface, 60 bottom plate, 75 hook member, 80 movable sealing member, A rotation axis, DR1, DR2 pivot direction, M medicine, O center line, R radial direction, Z axial direction.

The invention claimed is:

1. A medicine supply apparatus comprising:

a housing;

a drum disposed inside the housing, the drum being cylindrically shaped, a center line of the drum extending in an up-down direction; and a cover for covering side surfaces on four sides of the housing, the cover on a front side of the housing being configured to be openable and closable, the drum having four arc-shaped divided bodies, the four arc-shaped divided bodies being obtained by equally dividing the drum in a circumferential direction, and the drum being rotatable about the center line, the four arc-shaped divided bodies each having an inner circumferential surface having a partially cylindrical surface shape, the four arc-shaped divided bodies each having a plurality of medicine containing units each containing a medicine, the plurality of medicine containing units being arranged side by side in an axial direction and in a circumferential direction of the inner circumferential surface, and a plurality of axial passages each being formed to extend in the axial direction inward in a radial direction of the inner circumferential surface, such that the medicine discharged from each of the plurality of medicine containing units passes through one of the plurality of axial passages, wherein each of the four arc-shaped divided bodies is pivotable about a rotation axis that is spaced apart from the center line and that extends in parallel with the center line, and wherein one of the plurality of axial passages is exposed in a state where one of the four arc-shaped divided bodies is pivoted about the rotation axis in a direction away from the center line.

2. The medicine supply apparatus according to claim 1, wherein the inner circumferential surface forms a wall surface of the axial passage.

* * * * *